US005306593A

United States Patent [19]

Cunningham et al.

[11] Patent Number: 5,306,593

[45] Date of Patent: Apr. 26, 1994

[54] SUSPENSION POLYMERIZED TONER TREATED BY STARVED FEED MONOMER ADDITION PROCESS

[75] Inventors: Michael F. Cunningham, Georgetown; Hadi K. Mahabadi, Toronto, both of Canada

[73] Assignee: Xerox Corporation, Stamford, Conn.

[21] Appl. No.: 42,216

[22] Filed: Apr. 2, 1993

[51] Int. Cl.[5] ..... G03G 9/087

[52] U.S. Cl. ..... 430/137; 523/221; 526/203

[58] Field of Search ..... 430/137; 523/221; 526/203

[56] References Cited

U.S. PATENT DOCUMENTS

| | | | |
|---|---|---|---|
| 4,459,378 | 7/1984 | Ugelstad | 526/203 X |
| 4,486,559 | 12/1984 | Murata et al. | 523/468 |
| 4,680,200 | 7/1987 | Solc | 427/213.34 |
| 4,797,339 | 1/1989 | Maruyama et al. | 430/109 |
| 4,996,127 | 2/1991 | Hasegawa et al. | 430/109 |
| 5,043,404 | 8/1991 | Mahabadi et al. | 526/194 |
| 5,164,282 | 11/1992 | Mahabadi | 430/109 |
| 5,244,768 | 9/1993 | Inaba | 430/137 |

FOREIGN PATENT DOCUMENTS

| | | | |
|---|---|---|---|
| 144061 | 6/1989 | Japan | 430/137 |

*Primary Examiner*—Roland Martin
*Attorney, Agent, or Firm*—E. O. Palazzo

[57] ABSTRACT

A process for the preparation of toner particles which comprises a suspension polymerization followed by a starved feed monomer addition process and wherein the suspension polymerization comprises the formation of an organic phase comprised of monomer, initiator, pigment and optional toner additives; adding the organic phase to an aqueous phase comprised of water and a stabilizer; shearing the resulting organic and aqueous phase mixture; polymerizing the monomer by heating to enable toner particles; and wherein said starved feed addition comprises adding a second monomer, optionally with crosslinking agents or initiators, and heating to polymerize the added monomer.

18 Claims, No Drawings

SUSPENSION POLYMERIZED TONER TREATED BY STARVED FEED MONOMER ADDITION PROCESS

BACKGROUND OF THE INVENTION

This invention is generally directed to processes for the preparation of toner compositions, primarily in situ toners. Xerographic toners exhibiting low melt properties can be fused at lower temperatures than those toners typically used in xerography, resulting in reduced energy consumption, improved reliability, lower cost and higher speed. Low melt toners can be prepared by at least two general methods. The first method involves preparation of a low melt toner composition, while the second method is based on melt mixing polymers with widely varying properties to yield a composite material with the desired properties. For example, in U.S. Pat. No. 5,229,242 there is illustrated a toner comprised of a mixture of a linear polymer, which acts as the matrix polymer, a crosslinked polymer, which is incorporated to improve fusing latitude, a wax, which is added to provide lubrication, and a copolymer compatibilizer to enable dispersion of wax in the matrix polymer. Generally, the matrix polymer is a low molecular weight polymer with a suitably high glass transition temperature that provides the required low melting behavior to the toner. The polymer in the dispersed domains is a high molecular weight polymer that provides higher elasticity and, therefore, required hot offset behavior to the toner. The dispersed phase polymer may be crosslinked. It is also possible to use a low molecular weight but highly elastic polymer for the dispersed phase, for example low molecular weight polyolefins. Low melt toners may be prepared either by a conventional toner manufacturing approach based on pulverizing a resin that has been melt blended with pigments, charge control agents and other additives, or by an in situ toner process in which the final toner particles containing all necessary pigments, charge control agents and other additives are prepared directly in a chemical reactor. Regardless of whether the toner is prepared by an in situ approach or by a conventional pulverization approach, attainment of low melt properties requires that a dispersed phase of a polymeric material exists in a continuous matrix of another polymeric material. This requirement dictates that dispersion of the minor components be of excellent quality, that is the size of the dispersed phase domains should be as small as possible, preferably less than approximately one micron in diameter. However, there is considerable difficulty in preparing resins or particles with such a microphase morphology since most polymer pairs are not compatible, blending or mixing two polymers can be difficult. Achieving a level of mixing sufficiently intensive to reduce the size of the dispersed phase domains to the range of a micron or less is extremely difficult. Methods are known for preparing well-dispersed blends of incompatible polymers, one such method involving the use of a Banbury type mixer with very high shear at relatively low temperature to provide intensive mixing. One disadvantage of the Banbury process is that it is a batch process. Batch processes are generally uneconomical. Also, extruders cannot usually be operated at the low temperatures required to attain the same effective mixing provided by Banbury type mixers. Both the Banbury mixing and extrusion processes also suffer from the disadvantage of being applicable only to the preparation of conventional toner, and not to the preparation of in situ toner. Another approach that can be used to prepare polymer blends involves use of a compatibilizer, for example a block copolymer or a graft copolymer of one type of segment compatible with the continuous phase polymer, and one type of segment compatible with the dispersed phase polymer. When the polymers and the compatibilizer are blended, the compatibilizer preferentially locates at the interfacial regions between the phases, providing reduced interfacial tension and increased phase stability. The disadvantages of relying on compatibilizers include the addition of another polymer to the system which can further complicate the behavior, the difficulty in locating an adequate compatibilizer, and the fact that compatibilizers are primarily only effective for high shear conventional toner manufacturing. For in situ toner, processes to provide extensive mixing within the particles are not believed to exist. Furthermore, there is the concern that the compatibilized dispersed phase will not perform its desired function in the same manner as when it is not compatibilized. For example, very well compatibilized wax may not be as effective a lubricant as free wax.

Several in situ toner preparation methods are known. These processes include dispersion polymerization, suspension polymerization, emulsion polymerization, and the like. Disclosed in U.S. Pat. No. 4,486,559 is the preparation of a toner composition by the incorporation of a prepolymer into a monomer/pigment mixture, followed by emulsion polymerization. In suspension polymerization processes, the pigment and additives such as charge control components are added to a monomer or comonomers prior to polymerization. Particle formation is achieved by the dispersion of the pigmented monomer or comonomers in a continuous phase, such as water, and the droplets of pigmented monomers are then polymerized to form toner particles. One advantage of these processes as compared to many other methods is the elimination of fusion mixing (Banbury/extruder) and pulverization classification processing. Nevertheless, it can be difficult with these processes to accomplish polymerization of pigmented monomer droplets in a diameter range of 3 to 25 microns with a narrow distribution of particle diameter of, for example, 1.3.

Also mentioned are U.S. Pat. No. 4,486,559, which discloses the incorporation of a prepolymer into a monomer toner mix followed by emulsion polymerization, U.S. Pat. Nos. 4,680,200 and 4,702,988, which illustrate emulsion polymerization; and 4,797,339 and 4,996,127, which disclose aggregation processes in which small primary particles are produced by emulsion polymerization, which particles can contain pigment on the surface.

Also, recited are the following U.S. Patents disclosing suspension polymerization U.S. Pat. Nos. 4,077,804; 4,601,968; 4,626,489; 4,816,366 and 4,845,007; 5,043,404 directed to semisuspension polymerization; and U.S. Pat. No. 3,954,898, which discloses bulk and suspension polymerization.

In U.S. Pat. No. 5,164,282 (Mahabadi), the disclosure of which is totally incorporated herein by reference, there are illustrated processes for the preparation of toners, and more specifically, semisuspension polymerized toner processes in which a mixture of monomer or comonomers, a polymerization initiator, a crosslinking component and a chain transfer component is bulk polymerized until partial polymerization, that is for example from about 10 to about 40 percent of monomer or comonomers, is converted to a polymer; thereafter mixing the partially polymerized product with pigments, optional charge control agents and other additives with, for example, a high shear homogenizer to form a uniform organic phase, dispersing the organic phase in water containing a stabilizing component with, for example, a high shear mixer to produce a narrow particle size toner suspension; and polymerizing the suspension product. The toner obtained can then be washed/dried and dry blended with surface flow aid additives.

However, none of these processes for the preparation of toner involve the incorporation of a microphase dispersion of a second type of polymer in the continuous phase polymer, and obtaining an effective dispersion of a minor phase in a major phase. Similarly, there are a number of processes available for preparing polymer resins for conventional toner manufacturing based on a pulverization process. Toners have been prepared generally by fusion mixing of pigments (colorants), charge control agents and other additives into thermoplastic resins to disperse them uniformly therein. In view of the high viscosity of the mixture, a considerable amount of energy is needed to achieve uniform dispersion of pigments and other additives in the toner resin. The mixture is then cooled, followed by pulverization and classification into desired particle sizes and particle size distribution. It is known that pulverization is an energy intensive step in this process. This preparation method is capable of producing excellent toners, but requires the use of several steps which are costly, energy intensive and are limited in certain respects.

In the process for producing toners by pulverization, the material must usually be fragile so as to be readily pulverized to a certain extent. Therefore, some thermoplastic resins, which are not fragile but have acceptable fusing performance, are not usually selected for the aforementioned prior art processes. Also, if the material is too fragile, it may be excessively micropulverized and, therefore, the fines portion of the particles must be uneconomically removed. These limitations become increasingly severe for smaller particle size toners. Moreover, when a material with a low melting point is employed to improve fusing performance of the toner, fusion of such material may occur in the pulverizing device or the classifier. These processes are also unable to provide a microphase dispersion of a second type of polymer in the continuous phase of the matrix polymer. Therefore, there exists a need for a process for blending polymers that enables effective dispersion in either in situ toners or toner resin particles and, more specifically, a process for preparing particles containing different types of polymer resins consisting of one or more minor phase polymers dispersed extremely well throughout the continuous major phase. This process is based on the starved feed addition of a monomer to a suspension, semisuspension, emulsion or dispersion polymerization of polymeric particles comprised of a polymer that is incompatible with the polymer to be formed by the added monomer. Therefore, the process is amenable to suspension polymerization, dispersion polymerization, semisuspension polymerization or emulsion polymerization. In one embodiment, this process comprises a particle formation step in which pigment or dye particles and charge enhancing components are included, and then starved feed addition of another monomer occurs. Starved feed addition involves adding a monomer slowly enough that secondary droplets or polymer particles cannot form or are minimized, but rather all the added monomer diffuses through the aqueous phase and into existing particles. The starved fed monomer polymerizes to provide a polymer that is incompatible with the existing particles. Furthermore, the starved feed monomer is not more hydrophilic than the existing polymer/monomer particle to ensure that the starved feed monomer diffuses into the interior of the particle and does not form a shell around the exterior of the particle. If desired, initiator, chain transfer agent or crosslinking agent can be added to the starved feed monomer. Crosslinking agent could be used to provide very high molecular weight or crosslinked domains, while chain transfer agents could provide very low molecular weight domains. While the starved feed monomer is being added, heating continues. The added monomer, after diffusing into the particle interior, will begin to polymerize, and because it is incompatible with the matrix polymer, will phase separate into microdomains. These phase separated microdomains are thus formed in situ, unlike domains created by physical blending procedures. As the monomer actively polymerizes in the presence of the matrix polymer and perhaps monomer, it is also likely that some copolymerization or grafting will occur, thereby further enhancing the stability of the microdomains. Typical sizes of these domains are 0.05 to 3.0 microns in average diameter.

SUMMARY OF THE INVENTION

It is an object of the present invention to provide toner and developer compositions and processes thereof which possess many of the above noted advantages.

In another object of the present invention there are provided processes for the preparation of toners with high gloss, for example having gloss levels of about 40 to about 85 percent as measured by a 750 Gardner Gloss Meter.

In another object of the present invention there are provided processes for the preparation of toners with high fix, for example having a crease area of less than 65 square micrometers as determined by the crease test method.

Also, in another object of the present invention there are provided toner compositions and in situ processes thereof wherein the toner is comprised of a high molecular weight polymer contained in a matrix of a lower molecular weight polymer.

Also, in another object of the present invention there are provided toner compositions and in situ processes thereof wherein the toner is comprised of a high elasticity polymer, for example having a value of tan delta (ratio of the loss modulus to the storage modulus) of 0.02 to 1.0, contained in a matrix of a lower elasticity polymer.

Furthermore, in another object of the present invention there are provided improved toner compositions which can be fused at lower temperatures thereby reducing the amount of energy needed for effecting fusing of the image developed.

Moreover, in another object of the present invention there are provided developer compositions with positively, or negatively charged toner compositions that possess excellent electrical properties.

Also, in another object of the present invention there are provided toner compositions with stable triboelectric charging characteristics for extended time periods exceeding, for example, 300,000 imaging cycles.

Another object of the present invention resides in the provision of toner compositions with excellent blocking temperatures, and acceptable fusing temperature latitudes.

In another object of the present invention there are provided toner and developer compositions that are of low cost, nontoxic, nonblocking at temperatures of more than 50° F., jettable, melt fusible with a broad fusing latitude, and cohesive above the melting temperature thereof.

Also, in yet still another object of the present invention there are provided methods for the development of electrostatic latent images with toner compositions possessing high gloss and high fix characteristics.

Another object of the present invention resides in the provision of toner compositions which are insensitive to humidity of from about 20 to about 80 percent, and which compositions possess superior aging characteristics enabling their utilization for a substantial number of imaging cycles with very little modification of the triboelectrical properties and other characteristics, and which toner possess high gloss and high fixing characteristics.

Also, in another object of the present invention there are provided low melting toner compositions.

In still another object of the present invention there are provided toner and developer compositions for effecting development of images in electrophotographic imaging apparatus, including xerographic imaging and printing processes.

Further, in another object of the present invention there are provided processes for the generation of toner with a heterogeneous morphology of submicron domains of a very high molecular weight polymer in a matrix of a lower molecular weight polymer to thereby avoid or minimize poor toner fixing associated with high gloss low melting toners.

These and other objects of the present invention can be accomplished in embodiments by providing toner compositions and processes thereof. More specifically, in embodiments of the present invention there are provided toner compositions comprised of pigment particles, and a polymer or polymers comprised of a high molecular weight polymer dispersed in a low molecular weight polymer. With the processes of the present invention, there are provided toner compositions comprised of a polymer or polymer with a heterogeneous morphology comprised of submicron domains of a high molecular weight polymer contained in a matrix of a lower molecular weight polymer.

In embodiments, the processes of the present invention comprise a suspension polymerization followed by a starved feed monomer addition process. Starved feed refers in embodiments to the addition of the monomer at a low enough feed rate that secondary particles do not form, but rather the added monomer diffuses into the existing toner particles. The resulting toner particles have a morphology with high molecular weight polymer domains in a matrix of low molecular weight polymer, pigment, and other additives. The suspension polymerization comprises adding a mixture of monomers, initiators, pigments and other additives to form an organic phase; adding the organic phase to an aqueous phase consisting of water and a stabilizer, shearing the combined organic and aqueous phases, and polymerizing the monomers by heating. A second monomer, for example styrenes, acrylates, or methacrylates, is then starved fed to the toner particles, optionally with crosslinking agents or initiators, and the mixture heated to polymerize the added monomer. The resulting toner particles have a morphology with high molecular weight polymer domains in a matrix of low molecular weight polymer, pigment, and other additives.

In embodiments, the processes of the present invention comprise a semisuspension polymerization followed by a starved feed monomer addition process. The semisuspension polymerization comprises adding a mixture of monomers, initiators, pigments and other additives to form an organic phase; polymerizing the organic phase in a bulk polymerization until 10 to 40 percent of the monomer is converted to polymer; adding the organic phase to an aqueous phase of water and a stabilizer, shearing the combined organic and aqueous phases, and polymerizing the monomers by heating. A second monomer, for example styrenes, acrylates, or methacrylates, is then starved fed to the toner particles, optionally with crosslinking agents or initiators, and the mixture heated to polymerize the added monomer.

In embodiments, the processes of the present invention comprise an emulsion polymerization and aggregation of the emulsion particles with pigments, followed by a starved feed monomer addition process. The emulsion polymerization comprises adding a mixture of monomers, initiators, and other additives to form an organic phase; adding the organic phase to an aqueous phase consisting of water, initiators and a stabilizer; mixing the combined organic and aqueous phases; and polymerizing the monomers by heating. The small primary emulsion particles are then embedded with pigment by adding a mixture of pigment in aqueous surfactant solution and shearing, and then aggregated to give toner particles. A second monomer, for example styrenes, acrylates, or methacrylates, is then starved fed to the toner particles, optionally with crosslinking agents or initiators, and the mixture heated to polymerize the added monomer.

High molecular weight polymers comprise any one or more of several polymers commonly used to generate toner resins, including copolymers or polymers of styrenes, acrylates, methacrylates, acrylic acids, methacrylic acids, butadienes, polyesters, or polyolefins. High molecular weight could be achieved either by choice of appropriate reaction conditions or by addition of a crosslinking agent to the starved feed monomer. Typical high molecular weights would be in the range of about 300,000 to 7 million. Crosslinked polymer can be considered to have infinite molecular weight. The function of the high molecular weight polymer is to provide greater elasticity to the toner, thereby improving hot offset and release properties. Typically, the dispersed phase would represent 2 percent to 50 percent of the total particle by weight, and more commonly 5 percent to 25 percent.

The low molecular weight polymers comprising the particle matrix can comprise from, for example, one to three polymers commonly used to prepare toner resins, including copolymers or polymers of styrenes, acrylates, methacrylates, acrylic acids, methacrylic acids, butadienes, polyesters, or polyolefins. Low molecular weights would typically be in the range of about 5,000 to about 100,000. The function of the low molecular weight matrix polymer is to provide the low melt fusing behavior to the toner. Therefore, this material should also have a suitably high glass transition temperature and be of low cost.

Numerous well known suitable pigments or dyes can be selected as the colorant for the toner particles including, for example, carbon black like those available from Columbian Chemicals and Cabot Corporation; REGAL 330® carbon black, nigrosine dye, lamp black, iron oxides, magnetites, and mixtures thereof; cyan, magenta, yellow, red, green, blue, brown, and mixtures thereof. The pigment should be present in a sufficient amount to render the toner composition highly colored. Thus, the pigment particles are present in amounts of from about 1 percent by weight to about 25 percent by weight, based on the total weight of the toner composition, however, lesser or greater amounts of pigment particles can be selected.

Various magnetites, which are comprised of a mixture of iron oxides ($FeO.Fe_2O_3$) in most situations include those commercially available such as MAPICO BLACK®, can be selected for incorporation into the toner compositions illustrated herein. The aforementioned pigment particles are present in various effective amounts; generally, however, they are present in the toner composition in an amount of from about 10 percent by weight to about 25 percent by weight, and preferably in an amount of from about 16 percent by weight to about 19 percent by weight. Other magnetites not specifically disclosed herein may be selected provided the objectives of the present invention are achievable.

Examples of colored pigments other than black include known cyan, magenta, yellow, red, blue, green, and the like pigments such as 1,9-dimethyl-substituted quinacridone and anthraquinone dye identified in the Color Index as Cl 60720, Cl Dispersed Red 15, a diazo dye identified in the Color Index as Cl 26050, Cl Solvent Red 19, and the like. Examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy aceto-acetanilide, permanent yellow FGL, and the like.

A number of different charge enhancing additives may be selected to enable these compositions to acquire a positive charge thereon of from, for example, about 10 to about 35 microcoulombs per gram. Examples of charge enhancing additives include alkyl pyridinium halides, especially cetyl pyridinium chloride, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium methyl sulfate reference U.S. Pat. No. 4,560,635 the disclosure of which is totally incorporated herein by reference; and other similar known charge enhancing additives. These additives are usually incorporated into the toner in an amount of from about 0.1 percent by weight to about 15 percent by weight, and preferably these additives are present in an amount of from about 0.2 percent by weight to about 5 percent by weight.

Moreover, the toner composition can have present therein as internal or external components other additives such as colloidal silicas inclusive of AEROSOL® metal salts of fatty acids, such as zinc stearate, metal salts, and waxy components, particularly those with a molecular weight of from about 1,000 to about 15,000, and preferably from about 1,000 to about 7,000 such as polyethylene and polypropylene, which additives are generally present in an amount of from about 0.1 to about 1 percent by weight.

Toner compositions can be prepared by a number of known methods including melt blending the toner resin or polymer particles obtained with the processes of the present invention, pigment particles, and other additives, followed by mechanical attrition, and classification to enable toner particles with a volume average diameter of from about 5 to about 25 microns, and preferably from about 10 to about 20 microns. Other methods include those well known in the art such as spray drying, melt dispersion, dispersion polymerization, extrusion, and suspension polymerization. In one dispersion polymerization method, a solvent dispersion of the resin particles and the pigment particles are spray dried under controlled conditions to result in the desired product. Also, in embodiments the toner can be prepared by adding the pigment and other additives together with the high and low molecular weight polymer prior to the suspension, or semisuspension polymerization.

Characteristics associated with the toner compositions of the present invention include high gloss and high fix. By high gloss and high fix is meant, for example, having a gloss level of greater than 60 percent as determined using 750 Gardner Gloss Meter and having a crease area of less than 65 square micrometers as measured using the crease test method in which the crease area of a fixed image on paper, which has been deliberately folded, is measured to provide a quantitative measure of fix quality.

Also, the toner compositions obtained with the processes of the present invention can possess in embodiments a fusing temperature of less than about 245° F., and a fusing temperature latitude of from about 315° to about 450° F. Moreover, the aforementioned toners possess stable triboelectric charging values of from about 10 to about 45 microcoulombs per gram for an extended number of imaging cycles exceeding, for example, in some embodiments one million developed copies. Although it is not desired to be limited by theory, it is believed that two important factors for the slow, or substantially no degradation in the triboelectric charging values reside in the unique rheological properties of the toner polymer selected, and moreover, the stability of the carrier particles utilized. Also of importance is the consumption of less energy with the toner compositions of the present invention since they can be fused at a lower temperature, that is about 225° F. (fuser roll set temperature) compared with other conventional toners including those containing styrene butadiene resins, which fuse at from about 300° to about 330° F.

As carrier particles for enabling the formulation of developer compositions when admixed with the toner described herein, there are selected various known components including those wherein the carrier core is comprised of steel, ferrites, iron, polymers, and the like. Also useful are the carrier particles prepared by a powder coating process as illustrated in U.S. Pat. Nos. 4,937,166 and 4,935,326, the disclosures of which are totally incorporated herein by reference. More specifically, these carrier particles selected can be prepared by mixing low density porous magnetic, or magnetically attractable metal core carrier particles with from, for example, between about 0.05 percent and about 3 percent by weight, based on the weight of the coated carrier particles, of a mixture of polymers until adherence thereof to the carrier core by mechanical impaction or electrostatic attraction; heating the mixture of carrier core particles and polymers to a temperature, for example, of between from about 200° F. to about 550° F. for a period of from about 10 minutes to about 60 minutes enabling the polymers to melt and fuse to the carrier core particles; cooling the coated carrier particles; and thereafter classifying the obtained carrier particles to a desired particle size.

Illustrative examples of polymer coatings selected for the carrier particles include those that are not in close proximity in the triboelectric series. Specific examples of polymer mixtures used are polyvinylidene fluoride with polyethylene; polymethylmethacrylate and copolyethylenevinylacetate; copolyvinylidene fluoride tetrafluoroethylene and polyethylene; polymethylmethacrylate and copolyethylene vinylacetate; and polymethylmethacrylate and polyvinylidene fluoride. Other coatings, such as polyvinylidene fluorides, flourocarbon polymers, including those avaiable as FP-461, terpolymers of styrene, methacrylate, and triethoxy silane, polymethacrylates, reference U.S. Pat. Nos. 3,467,634, and 3,526,533 the disclosures of which are totally incorporated herein by reference, can be selected.

The percentage of each polymer present in the carrier coating mixture can vary depending on the specific components selected, the coating weight, and the properties desired. Generally, the coated polymer mixtures used contain from about 10 to about 90 percent of the first polymer, and from about 90 to about 10 percent by weight of the second polymer. Preferably, there are selected mixtures of polymers with from about 30 to about 60 percent by weight of the first polymer, and from about 70 to about 40 percent by weight of a second polymer.

Generally, from about 1 part to about 5 parts by weight of toner particles are mixed with from about 10 to about 300 parts by weight of the carrier particles illustrated herein enabling the formation of developer compositions.

The toner and developer compositions of the present invention may be selected for use in electrophotographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules, there can be selected the aryl amines disclosed in the '990 patent. Also, there can be selected as photogenerating pigments, squaraine compounds, thiapyrillium materials, and the like. These layered members are conventionally charged negatively, thus usually a positively charged toner is selected for development. Moreover, the developer compositions of the present invention are particularly useful in electrophotographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference. Images obtained with the developer compositions of the present invention possess acceptable solids, excellent halftones and desirable line resolution with acceptable or substantially no background deposits.

In embodiments, the present invention is directed to a process for the preparation of toner particles, which comprises a suspension polymerization followed by a starved feed monomer addition process, and wherein the suspension polymerization comprises the formation of an organic phase comprised of monomer, initiator, pigment and optional toner additives; adding the organic phase to an aqueous phase comprised of water and a stabilizer; shearing the resulting organic and aqueous phase mixture; polymerizing the monomer by heating to enable toner particles; and wherein said starved feed addition comprises adding a second monomer, optionally with crosslinking agents or initiators, and heating to polymerize the added monomer; a process for the preparation of toner particles which comprises a suspension polymerization followed by a starved feed monomer addition and wherein the suspension polymerization comprises adding a mixture of monomers, initiators, and pigments to form an organic phase; adding the organic phase to an aqueous phase comprised of water and a stabilizer; shearing the resulting organic and aqueous phases; and polymerizing the monomers by heating to enable toner particles and wherein said starved feed addition comprises adding a second monomer, optionally with crosslinking agents or initiators; and heating to polymerize the added monomer; a process for the preparation of a toner composition with a morphology of high molecular weight polymer domains in a matrix of low molecular weight polymer, pigment and optional toner additives and which process comprises a suspension polymerization; followed by a starved feed monomer addition wherein the suspension polymerization comprises adding a mixture of monomers, initiators, and additives to form an organic phase; adding the organic phase to an aqueous phase of water and a stabilizer; shearing the resulting mixture, and polymerizing the monomers, said starved feed is accomplished at an effective low feed rate to thereby avoid the formation of secondary particles and to enable the added monomer to diffuse into the toner resin particles; and an in situ process for the preparation of toner compositions which comprises mixing monomers, initiators, pigments and optional toner additives to form an organic phase, adding to the organic phase an aqueous phase of water and a stabilizer, shearing the mixture of organic and aqueous phases, polymerizing the monomers by heating, and when polymerization is at least 80 percent complete, adding to the said formed polymer a second monomer with optional initiator; polymerizing by heating; and cooling whereby there are formed domains of from about 0.05 to about 3 microns of a high molecular weight polymer with a $M_n$ of from about 5,000 to about 500,000, and a $M_w$ of from about 10,000 to about 1,000,000 contained in a matrix of a lower $M_n$ of from about 500 to about 50,000, and a $M_w$ of from about 1,000 to about 100,000, pigment and optional toner additives.

The following Examples are being supplied to further define the present invention, it being noted that these Examples are intended to illustrate and not limit the scope of the present invention. Parts and percentages are by weight unless otherwise indicated.

Generally, for the preparation of xerographic toners there are initially obtained the resin particles or these particles can be prepared as illustrated herein. Thereafter, there are admixed with the resins pigment particles and other additives by, for example, melt extrusion, and the resulting toner particles are classified and jetted to enable toner particles, preferably with an average volume diameter of from about 10 to about 20 microns.

EXAMPLE I

Styrene (45 grams) and butyl methacrylate (55 grams) were mixed with 5 percent of Cl Pigment Blue, 5 percent of azobisdimethylvaleronitrile initiator, and 1 percent of benzoyl peroxide initiator to form a homogeneous organic phase. To this organic phase were added 500 grams of a 1 percent of poly(vinyl alcohol) aqueous phase. The resulting mixture was homogenized in a Polytron blender for four minutes, and then polymerized by heating at 60° C. for five hours. After five hours, a mixture of 20 grams of styrene and 2 grams of divinylbenzene was starve fed (i.e. slowly added) to the above suspension at a rate of 0.25 gram/minute. Heating at 60° C. was continued for three hours and then the temperature was raised to 85° C. for one hour. The resulting suspension of 11 micron average volume diameter toner particles was comprised of 83 percent of a continuous matrix of 95 percent of a styrene/butyl methacrylate copolymer of 45 percent of styrene and 55 percent of butyl methacrylate with 5 percent Cl Pigment containing 17 percent of a dispersed phase of 91 percent of polymerized styrene and 9 percent of polymerized divinylbenzene. The toner particles were then washed and freeze dried. Transmission electron microscopy analysis in which all butyl methacrylate was stained clearly showed small phase separated microdomains of about 0.2 micron in diameter comprised of 91 percent of polymerized styrene and 9 percent of polymerized divinylbenzene. Fusing evaluation of the toner showed a high gloss level of 76 percent as measured using a Gardner Gloss Meter, and excellent fix as shown by a crease area of less than 65 square microns as determined by the crease test method.

COMPARATIVE EXAMPLE 1

The procedure of Example I was repeated, except that the starved feed monomer addition step is omitted. Styrene (45 grams) and butyl methacrylate (55 grams) were mixed with 5 percent of Cl Pigment Blue, 5 percent of azobisdimethylvaleronitrile initiator, and 1 percent of benzoyl peroxide initiator to form a homogeneous organic phase. To this organic phase was added 500 grams of a 1 percent poly(vinyl alcohol) aqueous phase. The resulting mixture was homogenized in a Polytron blender for four minutes, and then polymerized by heating at 60° C. for 5 hours and then the temperature was raised to 85° C. for one hour. The resulting suspension of 10 micron toner particles comprised of 95 percent styrene/butyl methacrylate copolymer consisting of 45 percent of styrene and 55 percent of butyl methacrylate with 5 percent of PV FAST BLUE™ pigment was washed and freeze dried. Fusing evaluation of the toner showed a high gloss level of 76 percent as measured using a Gardner Gloss Meter, but fix was poor in comparison to Example I. More specifically, for Comparative Example 1 there was crease area of 220 square microns as determined by the crease test method in comparison to less than 65 square microns for Example I, and which toner was easily smudged when hand rubbed, unlike Example I which did not smudge.

EXAMPLE II

Styrene (65 grams) was mixed with 5 percent of azobisdimethylvaleronitrile initiator, and 1 percent of benzoyl peroxide initiator to form a homogeneous organic phase. This organic phase was charged into a 1 liter steel reactor with 500 grams of a 0.1 percent poly(vinyl alcohol) aqueous phase. A charge of 35 grams of butadiene was injected into the reactor and the reactor pressure increased to 4 ATM. The resulting mixture was polymerized by heating at 60° C. for hours at a stirring rate of 750 rpm. After four hours, a mixture of 15 grams of styrene and 5 grams of divinylbenzene were slowly added to the above suspension at a rate of 0.10 gram/minute. Heating at 60° C. was continued for three hours and then the temperature was raised to 85° C. for one hour. The resulting suspension comprised a continuous matrix of styrene/butadiene copolymer consisting of 68 percent of styrene and 32 percent of butadiene containing a dispersed phase of 75 percent of polymerized styrene and 25 percent of polymerized divinylbenzene. These toner resin particles were washed and freeze dried. Mean particle size of these suspension polymerized particles was 420 microns. Transmission electron microscopy analysis in which the butadiene moieties were stained clearly showed small phase separated microdomains of 75 percent of polymerized styrene and 25 percent of polymerized divinylbenzene located throughout the suspension polymerized particles consisting of 83 percent of styrene/butadiene copolymer consisting of 68 percent of styrene and 32 percent of butadiene, and 17 percent of phase separated microdomains of 75 percent of polymerized styrene and 25 percent of polymerized divinylbenzene. The particles were then melt blended with 5 percent of Cl Pigment Blue and jetted to give a toner with mean particle size of 16 microns. Fusing evaluation of the toner showed a high gloss level of 81 percent as measured using a Gardner Gloss Meter, and excellent fix as shown by a crease area of less than 65 square microns as determined by the crease test method.

EXAMPLE III

Styrene (45 grams) and butyl methacrylate (55 grams) were mixed with 5 percent of Cl Pigment Blue, 0.5 percent of divinyl benzene, 5 percent of azobisdimethylvaleronitrile initiator, and 1 percent of benzoyl peroxide initiator, to form a homogeneous organic phase. This organic phase was bulk polymerized at 45° C. for 2 hours to a conversion near the onset of the gel effect, and then dispersed in 500 grams of an organic phase consisting of a 1 percent of poly(vinyl alcohol) aqueous phase. The resulting mixture was homogenized in a Polytron blender for four minutes, and then polymerized by heating at 60° C. for four hours. After four hours, a mixture of 18 grams of styrene, 2 grams of divinylbenzene and 1 gram of benzoyl peroxide was slowly added to the above suspension at a rate of 0.20 gram/minute. Heating was continued for three hours and then the temperature was raised to 85° C. for one hour. The resulting suspension of 9 micron toner particles comprised 84 percent of a continuous matrix of 95 percent styrene/butyl methacrylate copolymer consisting of 45 percent of styrene and 55 percent of butyl methacrylate with 5 percent of PV FAST BLUE TM pigment containing 16 percent of a dispersed phase of 90 percent of polymerized styrene and 10 percent of polymerized divinylbenzene was washed and freeze dried. Transmission electron microscopy analysis clearly showed small phase separated microdomains of 90 percent of polymerized styrene and 10 percent of polymerized divinylbenzene located throughout the toner particle. Fusing evaluation of the toner showed a high gloss level of 79 percent as measured using a Gardner Gloss Meter, and excellent fix as shown by a crease area of less than 65 square microns as determined by the crease test method.

Other modifications of the present invention may occur to those skilled in the art subsequent to a review of the present application, and these modifications are intended to be included within the scope of the present invention.

What is claimed is:

1. A process for the preparation of toner particles which comprises a suspension polymerization followed by a starved feed monomer addition process and wherein the suspension polymerization comprises the formation of an organic phase comprised of monomer, initiator, pigment and optional toner additives; adding the organic phase to an aqueous phase comprised of water and a stabilizer; shearing the resulting organic and aqueous phase mixture; polymerizing the monomer by heating to enable toner particles; and wherein said starved feed addition comprises adding a second monomer, optionally with crosslinking agents or initiators, and heating to polymerize the added monomer, which second monomer is slowly added to enable said monomer to diffuse through said aqueous phase and into said formed toner particles, and wherein secondary droplets or polymer particle formation is avoided or minimized prior to heating; and wherein said starved feed monomer has hydrophilic characteristics less than or equal to said monomer formed in the organic phase selected for said suspension polymerization and said second monomer has hydrophilic characteristics equal to or less than any polymer formed as a result of said suspension polymerization of said monomer to thereby ensure that said second monomer diffuses into the interior of the formed toner particle thereby avoiding formation of a shell around the exterior of said toner particles; and wherein subsequent to polymerization of the added second monomer there is formed a polymer that is incompatible with the formed said toner particles.

2. A process in accordance with claim 1 wherein there results toner particles with high molecular weight polymer domains contained in a matrix comprised of low molecular weight polymer, pigment, and optional toner additives.

3. A process for the preparation of toner particles which comprises a suspension polymerization followed by a starved feed monomer addition and wherein the suspension polymerization comprises adding a mixture of monomers, initiators, and pigments to form an organic phase; adding the organic phase to an aqueous phase comprised of water and a stabilizer; shearing the resulting organic and aqueous phases; and polymerizing the monomers by heating to enable toner particles and wherein said starved feed addition comprises adding a second monomer, optionally with crosslinking agents or initiators; and heating to polymerize the added monomer, which second monomer is slowly added to enable said monomer to diffuse through said aqueous phase and into said formed toner particles, and wherein secondary droplets or polymer particle formation is avoided or minimized prior to heating; and wherein said starved feed monomer has hydrophilic characteristics less than or equal to said monomer formed in the organic phase selected for said suspension polymerization and said second monomer has hydrophilic characteristics equal to or less than any polymer formed as a result of said suspension polymerization of said monomer to thereby ensure that said second monomer diffuses into the interior of the formed toner particle thereby avoiding formation of a shell around the exterior of said toner particles; and wherein subsequent to polymerization of the added second monomer there is formed a polymer that is incompatible with the formed said toner particles.

4. A process for the preparation of a toner composition with a morphology of high molecular weight polymer domains in a matrix of low molecular weight polymer, pigment and optional toner additives, which process comprises a suspension polymerization, followed by a starved feed monomer addition wherein the suspension polymerization comprises adding a mixture of monomers, initiators, and additives to form an organic phase; adding the organic phase to an aqueous phase of water and a stabilizer; shearing the resulting mixture; and polymerizing the monomers,; and wherein said starved feed addition comprises adding a second monomer and heating to polymerize said second monomer, which second monomer is slowly added to enable said monomer to diffuse through said aqueous phase and into said formed toner particles, and wherein secondary droplets or polymer particle formation is avoided or minimized prior to heating; and wherein said starved feed monomer has hydrophilic characteristics less than or equal to said monomer formed in the organic phase selected for said suspension polymerization and said second monomer has hydrophilic characteristics equal to or less than any polymer formed as a result of said suspension polymerization of said monomer to thereby ensure that said second monomer diffuses into the interior of the formed toner particle thereby avoiding formation of a shell around the exterior of said toner particles; and wherein subsequent to polymerization of the added monomer there is formed a polymer that is incompatible with the formed said toner particles.

5. A process in accordance with claim 4 wherein a semisuspension polymerization is selected which comprises adding a mixture of monomers and initiators to form an organic phase; polymerizing the organic phase in a bulk polymerization step until from about 10 to about 40 percent of the monomers is converted to polymer; adding the organic phase to an aqueous phase of water and a stabilizer; shearing the resulting mixture of organic and aqueous phases; and polymerizing the monomer by heating.

6. An in situ process for the preparation of toner compositions which comprises mixing monomers, initiators, pigments and optional toner additives to form an organic phase; adding to the organic phase an aqueous phase of water and a stabilizer; shearing the mixture of organic and aqueous phases; polymerizing the monomers by heating; and when polymerization is at least 80 percent complete, adding to the said formed polymer a second monomer with optional initiator; polymerizing by heating; and cooling whereby there are formed domains of from about 0.05 to about 3 microns of a high molecular weight polymer with a $M_n$ of from about 5,000 to about 500,000, and a $M_w$ of from about 10,000 to about 1,000,000 contained in a matrix of a lower $M_n$ of from about 500 to about 50,000, and a $M_w$ of from about 1,000 to about 100,000 pigment and optional toner additives, and wherein said second monomer is added by starved feed addition, which second monomer is slowly added to enable said monomer to diffuse through said aqueous phase and into said formed toner particles, and wherein secondary droplets or polymer particle formation is avoided or minimized prior to heating; and furthermore wherein said starved feed monomer has hydrophilic characteristics less than or equal to said monomer formed in the organic phase selected for said suspension polymerization and said second monomer has hydrophilic characteristics equal to or less than any polymer formed as a result of said suspension polymerization of said monomer to thereby ensure that said second monomer diffuses into the interior of the formed toner particle thereby avoiding formation of a shell around the exterior of said toner particles; and wherein subsequent to polymerization of the added monomer there is formed a polymer that is incompatible with the formed said toner particles.

7. A process in accordance with claim 3 wherein the second monomer is added with crosslinking agent, and wherein the dispersed domains are crosslinked.

8. A process in accordance with claim 3 wherein the second monomer is slowly added in a period of time of from about 0.1 gram/minute to about 5.0 grams/minute per 100 grams of toner particles in the reactor, and wherein secondary particles do not form, but rather the added monomer diffuses to the existing toner particles.

9. A process in accordance with claim 4 wherein the suspension polymerization comprises a process in which a mixture of monomer or comonomers, a polymerization initiator, a crosslinking component, a chain transfer component with pigments, and charge control agents is mixed with a high shear homogenizer to form a uniform organic phase; dispersing the organic phase in water containing a stabilizing component with a high shear mixer to produce a narrow particle size toner suspension; and polymerizing the suspension product.

10. A process in accordance with claim 4 wherein the semisuspension polymerization comprises a process in which a mixture of monomer or comonomers, a polymerization initiator, a crosslinking component, chain transfer component, and pigments is bulk polymerized until partial polymerization, and from about 10 to about 40 percent of monomer or comonomers is converted to a polymer; thereafter mixing the partially polymerized product with pigments, and optional charge control agents with a high shear homogenizer to form a uniform organic phase, dispersing the organic phase in water containing a stabilizing component with a high shear mixer to generate a narrow particle size toner suspension; and polymerizing the suspension product.

11. A process in accordance with claim 4 wherein small primary particles are produced by emulsion polymerization, and said particles are embedded with pigment on the surface and aggregated.

12. A process in accordance with claim 1 wherein the additive is a charge additive present in an amount of from about 0.05 to about 5 weight percent.

13. A process in accordance with claim 3 wherein there is further included a charge additive incorporated into the toner, or present on the surface of the toner.

14. A process in accordance with claim 3 wherein the toner's rate of charging is from about 15 seconds to about 60 seconds by frictional charging against suitable carrier particles via roll milling.

15. A process in accordance with claim 3 wherein the polymer is comprised of styrene polymers, acrylic or methacrylic polymers, polyesters, or mixtures thereof.

16. A process in accordance with claim 3 wherein the polymer is comprised of styrene acrylates, styrene methacrylates, polyesters, or styrene butadienes.

17. A process in accordance with claim 3 wherein the pigments are carbon black, magnetites, or mixtures thereof, cyan, magenta, yellow, red, blue, green, brown pigments and, mixtures thereof.

18. A process in accordance with claim 3 wherein the polymerization temperatures selected are in the range of 50° to 95° C., wherein polymerization times are from about 2 hours to 12 hours, and wherein in the preparation of the organic phase comprising monomers, initiators, pigments, chain transfer agents, and crosslinking agent; the initiators comprise 0.1 to 10 percent, the pigments comprise 1 to 7 percent, the chain transfer agents comprise 0.1 to 10 percent, and the crosslinking agents comprise 0.01 to 10 percent; and wherein the starved feed monomer comprises 2 to 30 percent of the toner particle, the yield of toner particle or toner resin particle is from about 75 percent to about 95 percent, wherein the mean particle diameter is from 3 to 20 microns with a geometric standard deviation of 1.1 to 1.3 for said toner particles, and wherein the mean particle diameter is from 100 to 1,000 microns with a geometric standard deviation of from about 1.2 to about 2.0 for the toner polymer particles.

* * * * *